US006227156B1

(12) United States Patent
Autrey et al.

(10) Patent No.: US 6,227,156 B1
(45) Date of Patent: May 8, 2001

(54) ROCKER ARM FOR A VALVE TRAIN OF AN INTERNAL COMBUSTION ENGINE

(75) Inventors: Jennifer Autrey, Clarkston; Dale Frank, Fenton, both of MI (US); Bernd Abel, Cheraw, SC (US); Horst Döppling, Herzogenaurach (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/464,891

(22) Filed: Dec. 16, 1999

Related U.S. Application Data

(60) Provisional application No. 60/120,794, filed on Feb. 19, 1999.

(51) Int. Cl.[7] ..... F01L 1/18; F01M 9/10

(52) U.S. Cl. ..... 123/90.41; 123/90.33; 123/90.37; 74/559; 184/6.9

(58) Field of Search ..... 123/90.33, 90.36, 123/90.37, 90.39, 90.41; 74/519, 559; 184/6.5, 6.9

(56) References Cited

U.S. PATENT DOCUMENTS 3,096,749 * 7/1963 Davidson ..... 123/90.39
3,289,657 * 12/1966 Winter, Jr. ..... 123/90.33
3,410,366 * 11/1968 Winter ..... 184/6.9
4,624,223 * 11/1986 Wherry et al. ..... 123/90.44
5,063,889 * 11/1991 Pryba et al. ..... 123/90.39
5,123,384 * 6/1992 Abbas ..... 123/90.39
5,671,707 * 9/1997 Purcell et al. ..... 123/90.37
5,730,093 * 3/1998 Calka et al. ..... 123/90.39
5,887,474 * 3/1999 Cutshall et al. ..... 72/315

* cited by examiner

*Primary Examiner*—Weilun Lo
(74) *Attorney, Agent, or Firm*—Bierman, Muserliannnn & Lucas

(57) ABSTRACT

The invention relates to a rocker arm (1) of a valve train of an internal combustion engine. This rocker arm (1) comprises two longitudinally extending side walls (2, 3) which enclose an intermediate space (16) while being connected to each other by a crossbeam (4) to form a U-shaped cross-section. According to the invention, a separate channel (24) for the transport of lubricant is created on a top surface (22) of the crossbeam (4). This channel (24) starts from an abutment (9) for an end of a push rod on the undersurface (8) of the crossbeam (4) and leads to a support (12) for an end of a gas exchange valve in the region of a second end (11) of the crossbeam (4).

9 Claims, 2 Drawing Sheets

ROCKER ARM FOR A VALVE TRAIN OF AN INTERNAL COMBUSTION ENGINE

This application claims the benefit of Provisional No. 60/120,794 filed Feb. 19, 1999.

DESCRIPTION

1. Field of the Invention

The invention concerns a rocker arm for a valve train of an internal combustion engine comprising two longitudinally extending side walls enclosing an intermediate space while being connected to each other by a crossbeam to form a U- or H-shaped cross-section, the crossbeam possessing an abutment for an end of a push rod on a first end of its undersurface and a support for an end of a gas exchange valve on a second end of the undersurface, each side wall having a bearing shell arranged in the region of a central transverse plane of the rocker arm, said bearing shells being aligned to each other for receiving a pivot axle, an aperture for a supporting pedestal for fixing the pivot axle being arranged in the crossbeam in the region of the bearing shells, a top surface of the crossbeam being intersected in the region of the abutment by at least one end of at least one passage for transporting lubricant, which passage starts from the end of the push rod.

2. Background of the Invention

In a rocker arm of the pre-cited type known from U.S. Pat. No. 4,944,257, the semispherical recess for receiving an end of a push rod is intersected by a bore for lubricant. Seen from one end of the rocker arm, a splash plate spaced therefrom extends from a top surface of the crossbeam of the rocker arm towards the other end of the rocker arm. This splash plate is intended to communicate with said bore so as to disperse the oil exiting from the bore over a large region of the rocker arm.

A drawback of the rocker arm of this species-defining document is that no measures are provided for ensuring a controlled and economic lubricant supply to a contact surface of a support for an end of a gas exchange valve on the rocker arm. This leads to unnecessary wear in the region of the support particularly if cold starts are frequent. At the same time, it must be noted that this type of splash lubrication of the rocker arm requires a large amount of lubricant, and, especially following a cold start of the internal combustion engine, a considerable amount of time until, finally, the contact surface of the support of the gas exchange valve on the rocker arm is adequately lubricated.

OBJECT OF THE INVENTION

The object of the invention is therefore to create a rocker arm of the pre-cited type in which the mentioned drawbacks are eliminated and to provide, notably with the help of simple measures, a controlled lubrication of the support of the rocker arm on the end of the gas exchange valve.

SUMMARY OF THE INVENTION

The intermediate space together with the side walls having the bearing shells faces away from the gas exchange valve, a separate channel for transporting the lubricant being arranged on the top surface of the crossbeam, said channel starting from the end of the passage in the crossbeam and extending to the end of the gas exchange valve.

This separate channel serves to effectively eliminate the drawbacks of the rocker arm described hereinbefore. In particular, a high-precision lubrication of the said support of the gas exchange valve on the rocker arm is possible. The separate channel at the same time permits the entire rest of the rocker arm including the bearing shells on the side walls to be made in one piece.

In a further development of the invention, the channel extends in a bridge-like element which is fixed on the top surface of the crossbeam or on end faces of the side walls having the same orientation with respect to the top surface. Thus, at least one channel for the transport of the lubricant starting from the passage in the abutment is created in this element. It is, however, also conceivable to arrange a single "tube" or a similar element on the top surface. Said element leads in the region of the second end of the rocker arm to a bore, not specified herein, through the crossbeam directly to the support of the gas exchange valve on the undersurface of the crossbeam. Alternatively, the crossbeam may comprise a bore for splash lubrication arranged at a distance from this support. It is equally conceivable to arrange a trough on the top surface of the crossbeam in the region of the support, in which trough lubricant exiting from the element in this region is accumulated and can be conveyed to the support through a bore of the crossbeam in this region.

If the rocker arm is to be fixed on a supporting pedestal via a pivot axle, according to the invention, a recess is likewise provided in the element in the region of the aperture.

Advantageously, the element is fixed to the top surface of the crossbeam, for example, by a welded or similar joint. However, alternative joining methods such as clamping, locking and gluing are also proposed.

The element of the invention for the transport of lubricant is advantageously made of a thin-walled sheet metal material or of a light-weight material like plastic in or on which the channel for the further transport of lubricant is formed.

In a further advantageous embodiment of the invention, the entire rocker arm is made of a sheet metal material which proves to be particularly advantageous from the point of view of manufacturing cost and time. At the same time, the proposed sheet metal material guarantees the required strength of the rocker arm. Through this measure, friction in the valve drive can be reduced.

It is particularly advantageous to make also the bearing shells integrally with the rocker arm. This permits the bearing shells to be formed simultaneously with the rocker arm by a deep-drawing or similar procedure.

For a further reduction of friction in the valve train, it is proposed to arrange rolling bearings such as needle bearings in the bearing shells. Alternatively, it is also possible to use ball or roller bearings.

According to a further advantageous embodiment of the invention, the side walls may be narrowed at least in the region of one of the ends of the crossbeam. By this, the rigidity of the rocker arm can be additionally increased and, when required, its mass reduced.

Finally, the invention proposes a simple measure for mounting the end of the push rod on the first end of the crossbeam. This mounting arrangement (abutment) is configured as a semi-spherical recess. Starting from this semi-spherical recess, it is possible to realize an excellent further transport of the lubricant coming from the push rod to the channel in the separate element. At the same time, a proper guidance of the rocker arm on the end of the push rod is created.

It is understood that the scope of the invention also covers embodiments in which the rocker arm is not arranged on a separate supporting pedestal but on an axle common to a number of rocker arms. At the same time, the element provided by the invention for the transport of lubricant can also be used with other bridge-type cam followers such as oscillating arms or finger levers which have a U- or H-shaped cross-section and in which lubricant is to be transported along their longitudinal axis.

BRIEF DESCRIPTION OF THE DRAWINGS

The invention will now be described more closely with reference to the drawings in which.

DETAILED DESCRIPTION OF THE DRAWINGS

Figure 1:
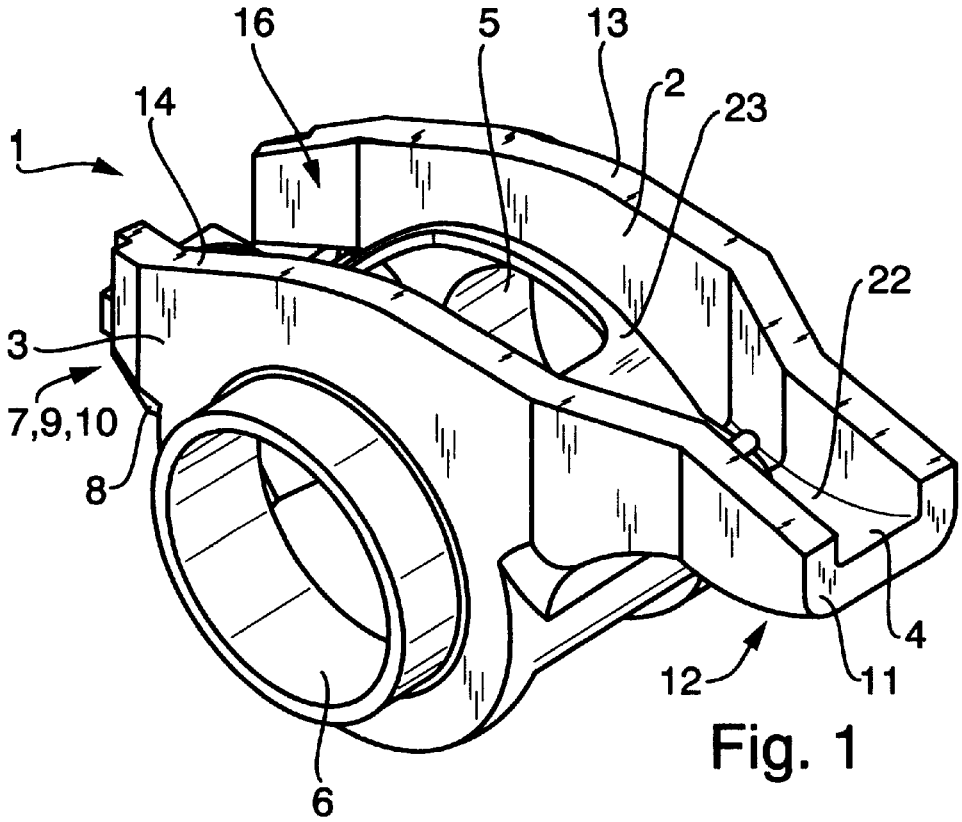
FIG. 1 is a perspective view of the rocker arm having a separate element.

FIG. 1 discloses a rocker arm 1 according to the present invention. This rocker arm 1 comprises two generally beam-type side walls 2, 3 which are connected to each other by a crossbeam 4. Seen in cross-section, the side walls 2, 3 and the crossbeam 4 form a U-shaped profile. Approximately in the region of a central transverse plane of the rocker arm 1, each of the side walls 2, 3 comprises a bearing shell 5, 6. These bearing shells 5, 6 serve to receive a pivot axle, not shown. The rocker arm 1 is fixed via this pivot axle with respect to a cylinder head of the internal combustion engine on a supporting pedestal, likewise not shown.

In the region of a first end 7 of an undersurface 8 of the crossbeam 4, there is formed an abutment 9 for an end of a push rod. In the present case, the abutment 9 is configured as a semi-spherical recess 10. In the region of a second end 11 of the undersurface 8 of the crossbeam 4, there is formed a support 12, needing no further description herein, for an end of a gas exchange valve. It is thus clear that the undersurface 8 is oriented towards the push rod and the gas exchange valve, while the end faces 13, 14 of the side walls 2, 3 face away from the push rod and the gas exchange valve.

Figure 3:
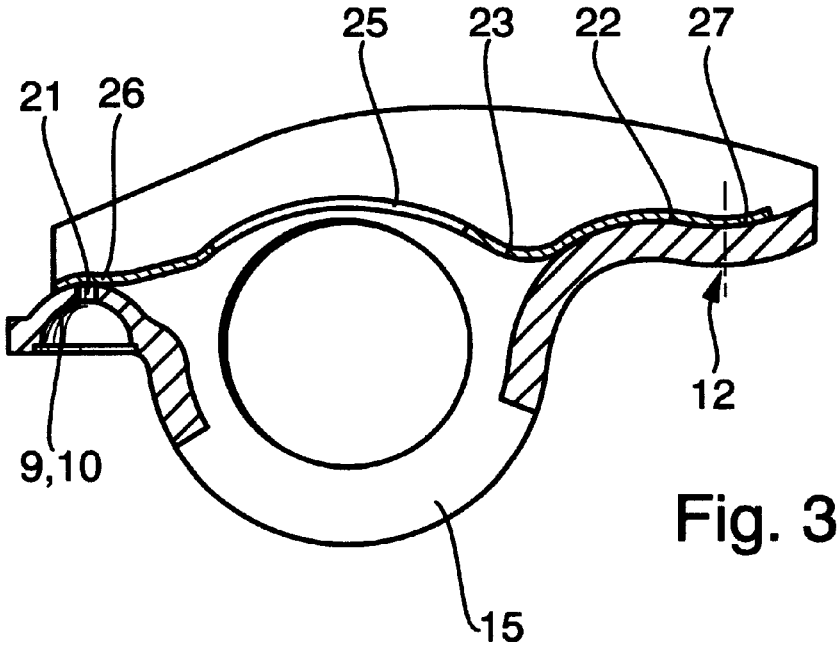
FIG. 3 shows a cross-section along the line of section III—III of FIG. 2

A person skilled in the art will see particularly in FIG. 3 that the crossbeam 4 comprises an aperture 15 in the region of the bearing shells 5, 6. This aperture 15 serves to receive the supporting pedestal mentioned hereinbefore. This supporting pedestal can be connected to the cylinder head, for example, by a screw means inserted through the aperture 15.

Figure 2:
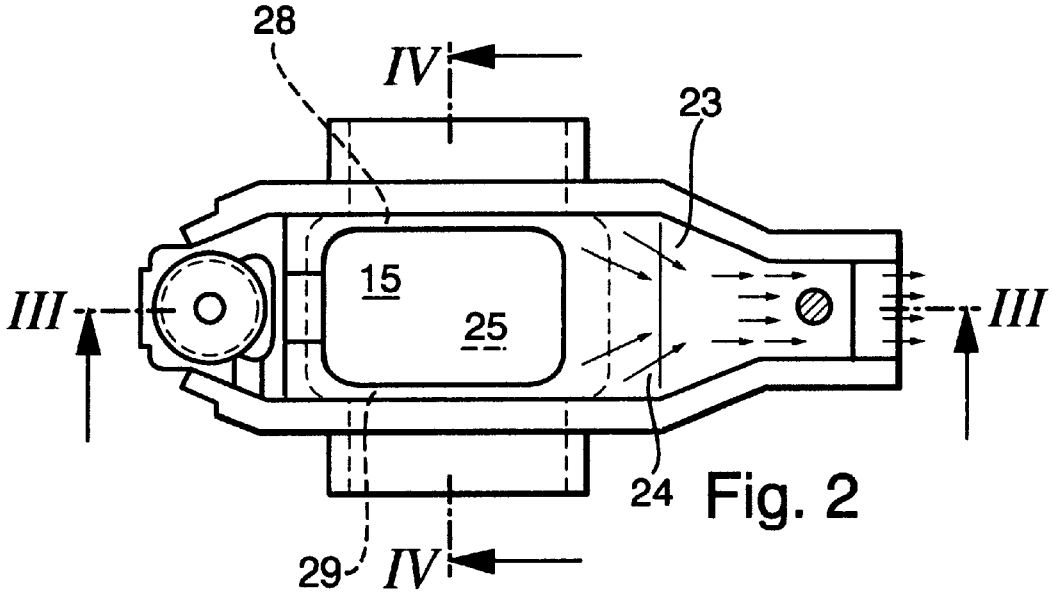
FIG. 2 is a top view of the rocker arm.

As disclosed more particularly in FIG. 2, the rocker arm is narrowed in the region of its first and second end 7, 11. This configuration results particularly in strength and weight advantages.

The figures illustrate further that the rocker arm 1 is made of a thin-walled material which can be, for example, steel sheet. Advantageously, its bearing shells 5, 6 are made integrally with the side walls 2, 3. This saves an additional work step such as welding.

FIGS. 1 and 3, in particular, disclose that the bearing shells 5, 6 are arranged on the side walls 2, 3 in such a way that their longitudinal axis extends preferably beneath the undersurface 8 of the crossbeam 4. In this region, the side walls 2, 3 are formed out of the undersurface 8 to resemble semi-shells.

Figure 4:
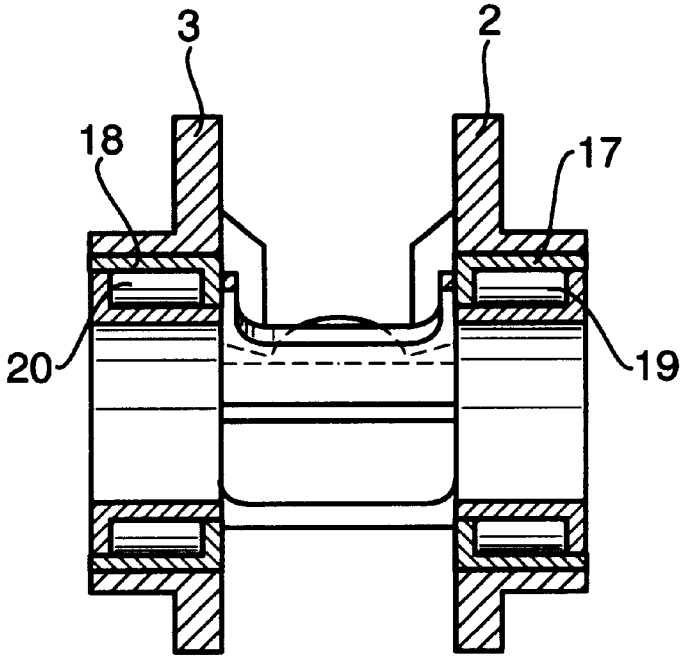
FIG. 4 shows a cross-section along the line of section IV—IV of FIG. 2.

FIG. 4 additionally shows that a rolling bearing 19, 20 (in the present case, needle bearing) extends in a bore 17, 18 of each of the bearing shells 5, 6. Through these rolling bearings 19, 20, the rocker arm 1 is mounted for pivoting on the already mentioned pivot axle.

As a person skilled in the art will see in FIGS. 2, 3, a passage 21 leads through the semi-spherical depression 10. This passage 21 serves for the further transport of lubricant from a duct extending through the push rod. This lubricant is then transported, by means still to be described, specifically to the support 12 of the crossbeam 4 on the end of the gas exchange valve. For this purpose, a bridge-like element 23 is fixed on a top surface 22 of the crossbeam 4. One or more channels 24 are provided (see particularly FIG. 2) in this element 23. Starting from the passage 21, the lubricant is transferred through these channels 24 directly to the support 12.

In the region of the aperture 15 of the crossbeam 4, the element 23 likewise comprises a recess 25. The element 23 is fixed at both its ends 26, 27 by a weld or similar joint (not shown) on the top surface 22 of the crossbeam 4. Thus, a simple, controlled and economic supply of the support 12 with lubricant can be realized. In the region of its end 26, for example, the element 23 can be configured so that its channel 24 overlaps a bore leading to the support 12. It is, however, also possible as provided in the present case, that the crossbeam 4 be made in the region of the support 12 in the form of a trough in which lubricant can collect and flow through the said bore to the support 12.

Advantageously, the element 23 is made as a sheet metal or plastic part. In this way, the entire cam follower 1, with the exception of the element 23, is made as an integral, one-piece structure.

In the region of the recess 25, the element 23 comprises longitudinal webs 28, 29 in contact with the side walls 2, 3, at least one channel 24 extending in at least one of these longitudinal webs 28, 29.

What is claimed is:

1. A rocker arm (1) for a valve train of an internal combustion engine comprising two longitudinally extending side walls (2, 3) enclosing an intermediate space (16) while being connected to each other by a crossbeam (4) to form a U- or H-shaped cross-section, the crossbeam (4) possessing an abutment (9) for an end of a push rod on a first end (7) of its undersurface (8) and a support (12) for an end of a gas exchange valve on a second end (11) of the undersurface (8), each side wall (2, 3) having a bearing shell (5, 6) arranged in the region of a central transverse plane of the rocker arm (1), said bearing shells (5, 6) being aligned to each other for receiving a pivot axle, an aperture (15) for a supporting pedestal for fixing the pivot axle being arranged in the crossbeam (4) in the region of the bearing shells (5, 6), a top surface (22) of the crossbeam (4) being intersected in the region of the abutment (9) by at least one end of at least one passage (21) for transporting lubricant, which passage (21) starts from the end of the push rod, characterized in that the intermediate space (16) together with the side walls (2, 3) having the bearing shells (5, 6) faces away from the gas exchange valve, a separate channel (24) for transporting the lubricant being arranged on the top surface (22) of the crossbeam (4), said channel (24) starting from the end of the passage (21) in the crossbeam (4) and extending to the end of the gas exchange valve and, the channel (24) extends in a bridge-like element (23) which is fixed on the top surface (22) of the crossbeam (4) in the region of the aperature (15) of the crossbeam (4), the bridge-like element (22) comprises a recess (25), on one or on both sides of which recess (25) the bridge-like element (4) comprises a longitudinal web (28, 29) which is arranged on the side wall (2, 3) in the region of the recess (25), and through which longitudinal web (28, 29), the channel (24) extends.

2. A rocker arm according to claim 1, characterized in that the side walls (2, 3) are narrowed at least in the region of one of the ends (7, 11) of the crossbeam (4), and are narrowed together with this end.

3. A rocker arm according to claim 1, characterized in that the abutment (9) in the crossbeam (4) for the end of the push rod is made as a semi-spherical recess (10).

4. A rocker arm according to claim 1, wherein the bridge-like element (23) is fixed at its two ends (26, 27) on the crossbeam (4) in the region of the first and the second end (7, 11) of the crossbeam (4) by a material locking, shape locking or shape and force locking joint.

5. A rocker arm according to claim 1, characterized in that the bridge-like element (23) is made of a thin-walled sheet metal material or of a light-weight material.

6. A rocker arm according to claim 1, characterized in that the rocker arm (1) is made of a sheet metal material by deep drawing or of a light-weight material.

7. A rocker arm according to claim 1, characterized in that the rocker arm (1) is made in one piece with the bearing shells (5, 6).

8. A rocker arm according to claim 1, characterized in that rolling bearings (19, 20) including needle bearings are arranged in bores (17, 18) of the bearing shells (5, 6).

9. A rocker arm according to claim 1, characterized in that the bearing shells (5, 6) are arranged on the side walls (2, 3) in such a way that their longitudinal axis extends beneath the undersurface (8) of the crossbeam (4), said side walls (2, 3) having a generally beam-like configuration in longitudinal direction while being formed in the region of the bearing shells (5, 6) out of the undersurface (8).

* * * * *